United States Patent [19]

Yang et al.

[11] 3,965,862

[45] June 29, 1976

[54] XEROGRAPHIC DEVELOPMENT SYSTEM

[75] Inventors: Frank Yang, Hacienda Heights, Calif.; Jerome E. Lamel, Plano, Tex.

[73] Assignee: Xerox Corporation, Stamford, Conn.

[22] Filed: Jan. 30, 1975

[21] Appl. No.: 545,560

[52] U.S. Cl. ..... 118/637; 15/1.5 R; 355/15

[51] Int. Cl.[2] ..... G03G 15/09

[58] Field of Search ..... 118/637; 427/18; 355/3 DD, 15; 15/1.5

[56] References Cited

UNITED STATES PATENTS

| | | | |
|---|---|---|---|
| 3,316,879 | 5/1967 | Washburn | 118/637 |
| 3,580,673 | 5/1971 | Yang | 118/637 |
| 3,645,770 | 2/1972 | Flint | 355/3 DD |
| 3,795,222 | 3/1974 | Jugle et al. | 118/637 |
| 3,854,449 | 12/1974 | Davidson | 118/637 |
| 3,882,823 | 5/1975 | Tanaka et al. | 118/637 |

*Primary Examiner*—Mervin Stein
*Assistant Examiner*—Douglas Salser
*Attorney, Agent, or Firm*—H. Fleischer; J. J. Ralabate; C. A. Green

[57] ABSTRACT

An apparatus for developing a latent image on a charged photosensitive surface of a xerography printing machine has a magnetic brush assembly including a donor roll and a cleaning electrode adjacent to the roll for reducing the accumulation of toner particles as a coating on the roll surface.

5 Claims, 2 Drawing Figures

XEROGRAPHIC DEVELOPMENT SYSTEM

Figure 1:
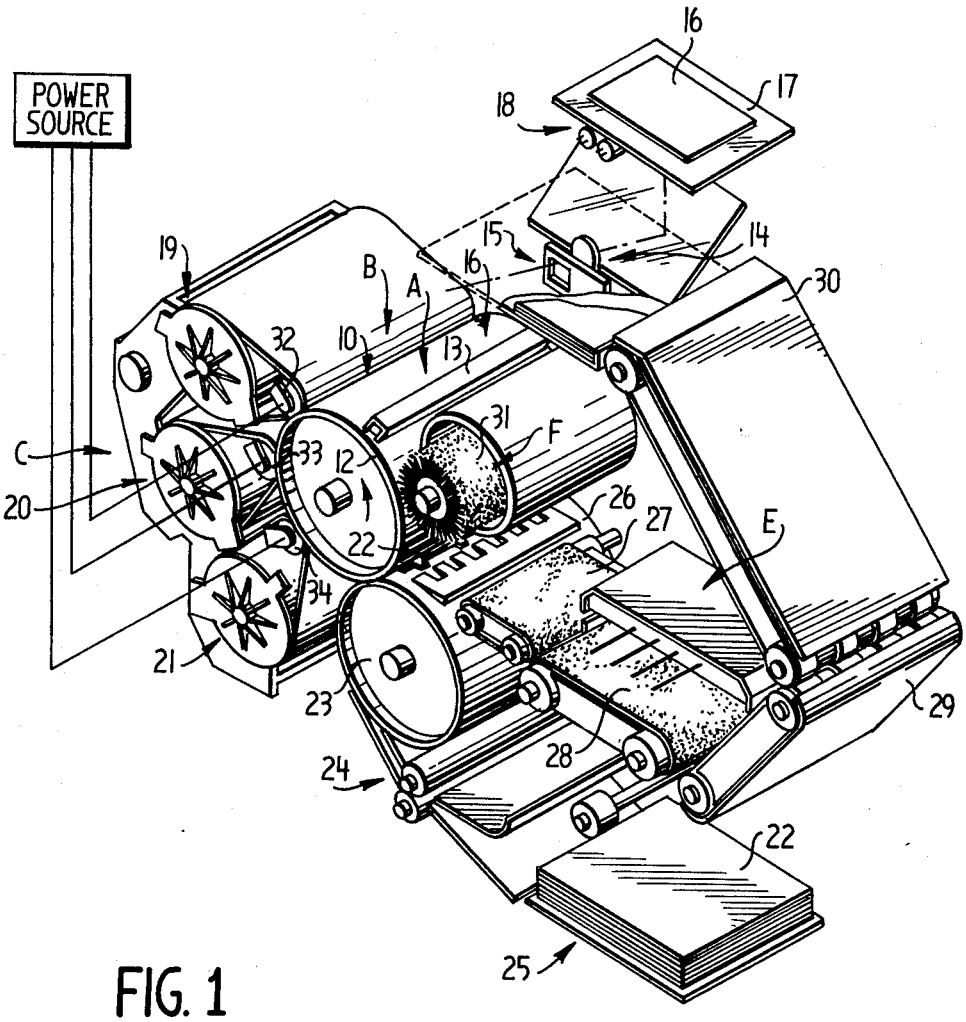

This invention relates generally to xerography and more particularly to an improved apparatus for developing a latent image on a photoreceptor drum of a xerographic copying machine.

Carlson in U.S. Pat. No. 2,297,691 issued Oct. 6, 1942, discloses a process and apparatus for making xerographic reproductions. In the practice of xerography, a photosensitive surface such as a xerographic plate having a layer of photoconductive insulating material supported on a conductive backing is uniformly electrostatically charged over its surface and then exposed to a light pattern of the image to be reproduced to discharge the photoconductor in the illuminated areas. The remaining charged areas form an electrostatic latent image which conforms with the configuration of the subject matter to be copied.

Multi-color xerography is generally similar to the process for making black and white copies except that subtractive color techniques are used to produce a plurality (usually three) of single color developed images which are superimposed on a sheet of paper or the like to form a printed copy of the original. Instead of forming a total light image of the document to be copied, the light image is filtered to produce three single color light images each of which is only a partial light image of the original.

Each latent electrostatic image is developed by contacting it with a finely divided electrostatic attractable, pigmented resinous powder referred to in the art as a toner adhering to a carrier material. The carrier is a material which appears in the triboelectric series at a point removed from that of the toner so that a charge is generated between the powder and carrier upon mutual interaction. This triboelectrical charging of opposite polarities causes the toner to adhere to the surface of the carrier. A portion of the developer material is applied to the latent image and the triboelectrically charged toner particles are selectively attracted thereto. The quality of the developed image is affected by the ratio of toner particles to carrier particles. If there is a deficiency of toner, the image areas will be unable to attract sufficient toner to develop fully the image. As a result, a light image is obtained. If, on the other hand, there is an excessive amount of toner in the toner-carrier mixture applied to the image area, the image will be too dark and some toner particles may be attracted to non-image areas.

In one method for developing the latent image in xerography, a developer material having toner particles on a magnetic carrier is used and a magnetic brush arrangement is used to bring the toner particles to a point where they will be attracted to the latent image on the photosensitive surface. Magnetic brushes disposed in a sump or bin of developer material for transporting the toner particles are disclosed, for example, in U.S. Pat. Nos. 2,791,949 and 3,815,988.

In multi-color xerography, a single color light image exposes the charged photoconductive surface. The potential on the charged photoconductive surface in the area irradiated by the single color light image is reduced. The potential of the charged photoconductive surface in the non-irradiated areas remain substantially unchanged. During development, toner particles, complementary in color to the single color light image, are deposited on the photoconductive surface. The irradiated areas remain substantially devoid of toner particles. The development system is electrically biased such that the potential thereof is intermediate those of the irradiated and non-irradiated areas. In this way, toner particles are attracted to the non-irradiated areas from the development system since the potential of the non-irradiated areas is greater than the potential of the development system, whereas toner particles are not attracted to the irradiated areas in as much as the charge thereof is less than that of the development system.

When there exists near the magnetic brush roll a surface which is electrically more negative, i.e. at a lower potential or zero, than the magnetic brush, toner particles will tend to migrate towards and coat the roll. This more negative charged surface may be a trim blade or background areas on the photoconductive surface of the photoconductor drum. The toner carries with it negative charges which partially neutralize the electrical bias on the magnetic roll. The purpose of the bias voltage on the magnetic roll is to suppress background development and undesirable densities of the developed images in color development. Accurate color separation requires that the bias voltage on the magnetic roll remain substantially constant at an effective biasing voltage because consistent prints are obtained only if the roll surface remains substantially free of accumulated toner particles.

It is therefore an object of this invention to provide a new and improved process and apparatus for developing latent images on a photoreceptive surface. Another object of the invention is to provide a means for avoiding toner build-up on a magnetic brush donor roll used in xerography in the development of a latent image. Still another object of the invention is to provide a new and improved apparatus and method for improving the quality of a color print produced by xerography.

Figure 2:
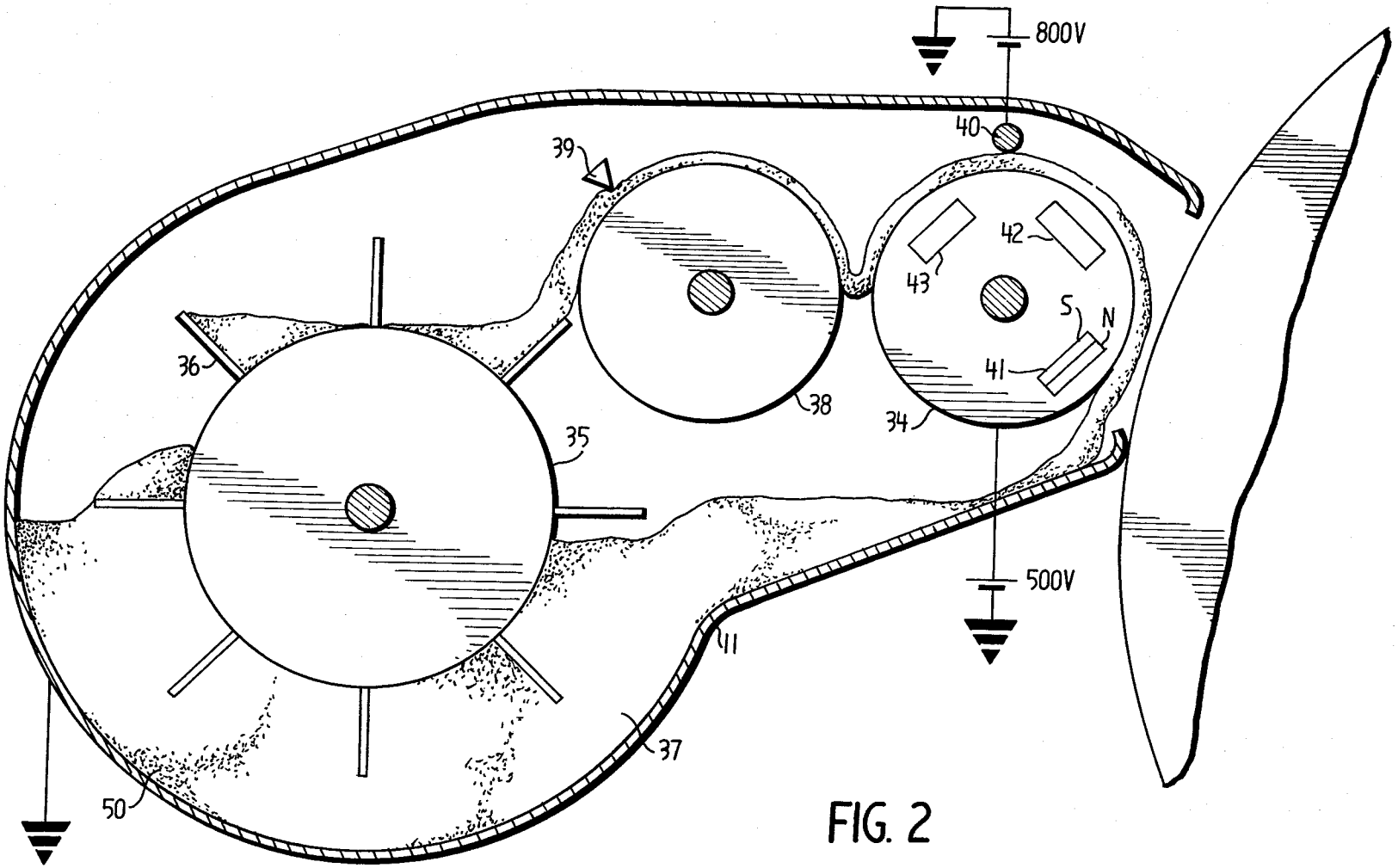

Other objects will become apparent from the following description with reference to the accompanying drawing wherein FIG. 1 is a schematic view in perspective of a xerographic printing machine provided with an embodiment of the invention; and FIG. 2 is an enlarged diagrammatic longitudinal section of an embodiment of the developer unit provided by the invention.

The foregoing objects and others are accomplished in accordance with this invention, generally speaking, by providing an electrophotographic printing machine having a magnetic brush assembly for applying developer material to a latent image on the surface of a photoconductive insulating material wherein a means is provided for preventing undesirable coating of the surface of the magnetic brush donor roll of the assembly. The apparatus is particularly advantageous for multi-color electrophotographic printing machines.

Referring now to the drawing, the printing machine illustrated in FIG. 1, has a drum 10 provided with a photoconductive surface 12, such as vitrous selenium or the like. Drum 10 is rotatably disposed within a suitable machine frame (not shown). As drum 10 rotates in the direction of the arrow, it passes a series of processing stations. One type of suitable photoconductive material 12 is disclosed in U.S. Pat. No. 3,655,377. The various machine operations are coordinated with one another to produce the correct sequence of events at the appropriate processing stations by a suitable logic circuitry.

At the first processing station A, a corona generating device 13 charges photoconductive surface 12 to a relatively high substantially uniform potential. The corona generating device 13 may be the one disclosed in U.S. Pat. No. 2,778,946.

Drum 10 rotates from station A to exposure station B which includes a moving lens system 14 and a color filter mechanism, illustrated generally, at 15. The lens system disclosed in U.S. Pat. No. 3,062,108 and a conventional color filter mechanism may be used. An original document 16, such as a sheet of paper or the like, is disposed upon transparent viewing platen 17 and is scanned by lamps 18. A light image of the original document 16 is projected onto charged photoconductive surface 12. Filter mechanism 15 is adapted to interpose selected color filters into the optical light path. The appropriate color filter operates on the light rays passing through the lens of system 14 to record a single color electrostatic latent image on surface 12.

Drum 10 rotates the single color electrostatic latent image to development station C which has three individual developer units 19, 20 and 21. The developer units 19, 20 and 21 are structurally identical. One contains cyan toner particles, another contains magenta toner particles and the third contains yellow toner particles on a magnetic carrier. At station C each of three latent images produced in series on the surface 12 is developed. The magnetic brush assembly illustrated in FIG. 2 is provided for this purpose and will be described in detail later.

Drum 10 next rotates to transfer station D where the toner powder image adhering electrostatically to photoconductive surface 12 is transferred to a suitable support material 22 such as a sheet of paper of the like. A transfer roll 23 rotates support material 22 in the direction of the arrow. Transfer roll 23 is electrically biased to a potential of sufficient magnitude and polarity to electrostatically attract toner particles from photoconductive surface 12 to the support material. A suitable biased transfer roll is disclosed in U.S. Pat. No. 3,612,677. Transfer roll 23 rotates in synchronism with drum 10. Support material 22 is secured to transfer roll 23 and successive toner powder images are transferred from pnotoconductive surface 12 to support material 22 in superimposed registration with one another. This produces a multi-color toner powder image corresponding in color to the original document 16 on the support material 22. A conventional sheet feeding mechanism designated generally as 24 feeds paper from stack 25 to transfer roll 23. After support material 22 is stripped from transfer roll 23 by stripper bar 26, the support material moves on endless belt conveyor 27 to station E where a fuser, such as that described in U.S. Pat. No. 3,498,392 permanently fixes the toner powder image to the support material 22. Conveyor belts 28 and 29 advance the support material 22 with its fused image to a tray 30.

Residual toner particles remaining on the photoconductive surface 12 are removed at a cleaning station F. A rotatably mounted brush 31 may be used for this purpose.

As illustrated in FIG. 1, a suitable power source is connected to magnetic developer donor rolls 32, 33 and 34 of the developer units 19, 20 and 21, respectively, to electrically bias each of the rolls to an appropriate potential such that the toner particles are attracted to the image areas instead of to the non-image areas on the photoconductive surface 12. Since the three developer units at station C are of the same construction, only one has been illustrated in a longitudinal sectional view in FIG. 2 of the drawing.

As shown in FIG. 2, developer unit 21 has a paddle wheel 35 provided with vanes 36 in a sump 37 enclosed by housing 11 and containing suitable developer material 50 comprising toner particles and magnetic carrier granules. The paddle wheel 35 stirs the developer material in the sump 37 and carries it to the vicinity of a toner-carrier transport roll 38. A suitable trim or doctor blade 39 is disposed in spaced relation with the surface of transport roll 38 a distance of about 0.060 inch so that the developer material carried on the surface of transport roll 38 beyond blade 39 is controlled and uniform in thickness. The developer material carried on the surface of roll 38 after it has rotated beyond trim blade 39 is attracted to the surface of magnetic donor roll 34.

Magnetic developer roll 34 rotates about magnets 41, 42 and 43 and is disposed in substantial contact with a sensitized surface layer 12 of drum 10. In this embodiment, a constant 500 volt (+) bias is applied to donor roll 34. A cleaning electrode 40 is disposed at about the nine o'clock position of donor roll 34. This cleaning electrode 40 may be a bar or rod electrically biased to a potential higher than that of roll 34. With a voltage of 500 on roll 34, the voltage on the electrode may be about 800 volts. The electrode 40 should be spaced from the surface of roll 34 a distance such that it is in contact with the developer mass on the surface of roll 34. Cleaning electrode 40 prevents the coating of roll 34 with toner particles because electrode 40 sets up an electrical field which causes migration of toner in a direction opposite from roll 34 to the electrode 40. The bar should be placed in a region of the magnetic field where the developer material carried by roll 34 constantly rubs and abrades electrode 40 to keep it free of toner. Preferably, electrode 40 is located in a position with respect to roll 34 where it is in the tangential region of the magnetic field. Housing 11 may be biased to a potential whereby toner particles will not be attracted to the inner surface thereof.

It has been found that developer roll 34 tends to become coated with an adherent layer of toner particles in an apparatus similar to that illustrated in the drawing but without an electrode 40. The negative charged toner layer causes an effective positive bias voltage of 500 volts to vary by as much as about 300 volts depending upon the input document. Since color separation relies on the ability of the development system bias to suppress development of low densities, uncontrolled variation in the effective bias voltage caused erratic color reproduction.

In order to demonstrate the effect of a surface such as a trim blade or the background areas on the photoconductor drum which is close to a magnetic brush roll and is electrically more negative than the roll on the migration of toner particles to the roll with the formation of a coating thereon, a 1½ inch diameter magnetic roll similar to roll 35 was rotated against a blade similar to member 39 spaced about 0.04 to 0.06 inch from the surface of the roll. A bias of 500 volts (+) was applied to the magnetic roll. A variable bias (+) was applied to the stationary blade to establish a variable potential between the rolls and blade and simulate input document variation. At each potential difference, the roll was rotated until its surface became saturated with developer material. This required about 15 seconds.

The developer material was then removed. An electrometer was placed over the roll and the net effective bias voltage was measured. The developer material was conventional magenta toner on a nickel berry carrier. The results without a cleaning electrode are shown in the following Table I:

TABLE I

| | | | | | | |
|---|---|---|---|---|---|---|
| Potential Difference Between Roll and Blade | 0 | 100v | 200v | 300v | 400v | 500v |
| Bias Applied to Roll | 500v | 500v | 500v | 500v | 500v | 500v |
| Effective Bias on Roll When Coated With Toner (4% Toner Concentration) | 440v | 430v | 400v | 280v | 160v | 60v |
| Effective Bias on Roll When Coated With Toner (3% Toner Concentration) | 460v | 460v | 440v | 420v | 380v | 300v |

It should be noted that the effective bias of the magnetic brush roll 39 may be reduced from 500v to only 60v if coated with toner.

The above test was repeated except that a bar type cleaning electrode similar to electrode 40 was installed in the tangential field region near the surface of the magnetic brush roll. The spacing between the electrode and magnetic brush roll was the same as the spacing between the trim member and the magnetic roll. The electrode was biased at 800v (+). The results obtained with the apparatus having an electrode cleaning member of the kind provided by this invention are given in the following Table II:

TABLE II

| | | | | | | |
|---|---|---|---|---|---|---|
| Potential Difference Between Roll and Blade | 0 | 100v | 200v | 300v | 400v | 500v |
| Bias Applied to Roll | 500v | 500v | 500v | 500v | 500v | 500v |
| Effective Bias on Roll When Coated With Toner (4% Toner Concentration) | 440v | 440v | 440v | 435v | 430v | 430v |
| Effective Bias on Roll When Coated With Toner (3% Toner Concentration) | 460v | 460v | 460v | 460v | 460v | 460v |

As illustrated by the results in Tables I and II, accumulation of toner on the magnetic brush roll is reduced significantly and reduction of effective bias on the roll is also reduced significantly. While a small amount of toner may still accumulate on the roll with a loss of as much as about 50v on the roll, the reduction is stable regardless of the potential difference between the roll and blade so variation in bias and non-uniform copy production are avoided.

Although the invention is described in detail for the purpose of illustration it is to be understood that such detail is solely for that purpose and that variations can be made therein by those skilled in the art without departing from the spirit and scope of the invention except as it may be limited by the claims.

What we claim is:

1. An apparatus for developing a latent image on a charged photoconductive surface wherein the potential in the area of the image is higher than that of the remainder of the said surface comprising a sump containing developer material comprising toner particles triboelectrically attracted to magnetic carrier granules, a rotatable magnetic applicator means disposed in the sump for applying toner particles to the photoconductive surface, said applicator means being electrically biased at a potential intermediate the potential in the area of the image and remaining areas of the said surface, and a stationary bar disposed in spaced substantially parallel relationship with the surface of said magnetic applicator means and extending throughout the length thereof, said bar being electrically biased to a potential greater than that on the applicator means but less than the potential of the latent image on the said photoconductive surface and said bar is disposed upstream of the photoconductive surface in the rotating path of the applicator means.

2. The apparatus of claim 1 comprising three separate sumps each having a transport means for developing multi-color images.

3. The apparatus of claim 1 wherein the rod is biased at a potential of about 800 volts and the applicator means is biased at a potential of about 500 volts.

4. The apparatus of claim 1 wherein the applicator means comprises a donor roll rotatable in a magnetic field and said apparatus comprises a rotatable paddle wheel in the sump, a transport roll for moving developer material towards the donor roll, and a means for trimming toner material from about the surface of the transport roll.

5. The apparatus of claim 4 wherein the spacing between the said trimming means and the transport roll and the spacing between the electrode and developer roll are substantially the same.

* * * * *